US006639134B2

(12) United States Patent
Schmidt

(10) Patent No.: US 6,639,134 B2
(45) Date of Patent: Oct. 28, 2003

(54) HIGH FLOW STRINGED INSTRUMENT SOUND HOLE

(75) Inventor: Eric Thomas Schmidt, Wichita, KS (US)

(73) Assignee: Eric T. Schmidt, Wichita, KS (US)

( * ) Notice: Subject to any disclaimer, the term of this patent is extended or adjusted under 35 U.S.C. 154(b) by 0 days.

(21) Appl. No.: 09/969,235

(22) Filed: Oct. 2, 2001

(65) Prior Publication Data

US 2002/0046636 A1 Apr. 25, 2002

Related U.S. Application Data

(60) Provisional application No. 60/237,623, filed on Oct. 3, 2000.

(51) Int. Cl.[7] ..... G10D 3/00
(52) U.S. Cl. ..... 84/291; 84/290; 84/293
(58) Field of Search ..... 84/290, 291, 293

(56) References Cited

U.S. PATENT DOCUMENTS 6,294,718 B1 * 9/2001 Saunders et al. ..... 800/290

* cited by examiner

*Primary Examiner*—Kimberly Lockett

(74) *Attorney, Agent, or Firm*—Brad Sylvester

(57) ABSTRACT

This invention provides for increased resonance quality and volume in a stringed instrument having a resonant chamber, where the chamber has a defined opening that is also known as a "sound hole." Guitars and related instruments tend to have sound holes defined as rounded or circular openings. Violins and related instruments tend to have a more ornate sound hole, similar to an "S" or "f" shape. The increase in sound volume and quality is derived from resonance flanges, that are positioned adjacent to the sound hole, within the resonance chamber, and which define curved surfaces that affect the sound waves striking them. The resonance flanges are defined by internal expanding curved edges, that are attached to the inner side of the resonant chamber, adjacent to the sound hole opening, and exhibit a defined curve away from the sound hole opening. As vibrational sound waves move into the resonant chamber, the sound waves strike various the inner walls of the chamber, and the pressure created by the sound waves are expelled back out the sound hole. The resonance flanges provide an increase in volume to the vibrational sound waves, due to the bell or horn shape of the flanges, which effect the sound saves in a manner similar to how a trumpet horn or bell shape affects the sound emanating from the tube end of a trumpet.

11 Claims, 3 Drawing Sheets

HIGH FLOW STRINGED INSTRUMENT SOUND HOLE

This application claims the benefit of provisional Application No. 60/237,623, filed Oct. 3, 2000.

BACKGROUND OF THE INVENTION

String instruments create sound waves through the vibration of their strings. The quality and appreciable volume of such created sound waves are enhanced through the use of resonance chambers which allow the entry and exit of sound waves into or from the resonance chamber through a sound hole. The art of resonance chambers has a significant impact on the richness that the sound being produced is able to achieve. The quality of materials used to create the resonance chamber, the position of the sound hole, and the structural design of the resonance chamber are all crucial to optimal sound resonance. The builders and designer of resonance chambers have struggled with the placement of barriers within the resonance chambers, and other design considerations, including that of the location, placement and dimensions of the sound holes used with specific resonance chambers.

Fluted openings, or openings having bell-shaped configurations, tend to increase of volume and richness of sound emanating from a smaller opening. This is clearly seen with such instruments as trumpets, or other such instruments in that family, where the horn end dramatically increases the volume and tonal quality of the sound the instrument is producing through a small tube. The sound enhancing qualities of a trumpet bell-shaped opening, with its curved symmetrical design, is incorporated into a string instrument through this invention, which utilizes the performance enhancements available through curved and flared flanges that are placed within a resonance chamber.

SUMMARY OF THE INVENTION

This invention provides for increased resonance quality and volume in a stringed instrument having a resonance chamber, where the chamber has a defined opening, also known as a sound hole, or "f" hole. The resonance chamber of a stringed instrument is able to receive the vibrational sound waves created by vibrating strings. These sound waves move through the air, and if a sound hole is immediately available, the sound waves will move through the sound hole into the resonance chamber. The resonance chamber defines a barrier which is able to isolate certain wavelengths of sound waves. The resonance chamber accepts any pressure, caused by the vibrating string, and resultant sound waves, and expels the sound waves back out the sound hole. The general effect is to increase the volume level of the musical instrument, through a compounding of sound waves projected immediately from the vibrating strings, and also out the resonance chamber sound hole.

The invention comprises flanges that are defined within a resonance chamber, where the flange or flanges comprise curved surfaces that extrude into the resonance chamber from the lip of the sound hole. These flanges have two variations. The first variation is usable with a round or circular sound hole. In this first variation, the resonance chamber associated with the round or circular sound hole, a single circular flange having a minimum diameter and circumference equal to the sound hole is declined within the resonance chamber. The flange itself is similar in nature and operation to a bell or flared trumpet horn end. The flange, when it has a curvature of approximately 90 degrees, will present an entry/exit sound hole opening for the resonance chamber. The flange itself will be similar to a portion of a trumpet horn, so that sound waves exiting the resonance chamber will be subjected to an expanding fluted flange, that will increase the quality and volume similar to a trumpet horn end does.

The flange in the variation described above does not tend to improve tonal quality and volume for sound waves only entering into the resonance chamber. The benefit is derived from the flanges when the sound waves exit the sound hole, being then able to take advantage of the bell-shaped fluted configuration of the flanges, similar to a horn or trumpet end. If the flange exhibits a curvature greater than 90 degrees, it will then define both a decreasing and increasing curvature opening. As the sound waves move into the resonance chamber in this variation, the sound waves will move through the space defined by the flange, where the circumference of the flange opening is decreasing, and once past the minimum diameter of the flange, move through an expanding fluted curvature, similar to a horn end. In such a variation, the sound waves can take advantage of the benefits of a horn or fluted end, both through complete entry into the resonance chamber, as well as by exiting the resonance chamber. Curvature of the flange in excess of 360 degrees will provide additional tubular chamber within the resonance chamber, that have the benefit of increasing the overall surface area of the barriers provided within a single resonance chamber, and may be useful in sound quality enhancement.

The second variation of this invention allows multiple flanges to be used around a single sound hole. One such use is exemplified through a violin, where the sound hole is defined as a curved flowing opening, similar to a scripted "f". Due to the complex curvature associated with the sound hole opening itself, two flanges are optimally associated with this single sound hole.

These second variation flanges are defined similarly as the flange noted above, with the difference being that the second variation flange follows the curvature of the sound hole, and does not extend all the way around the sound hole. In by placing one such flange, which has the general configuration of a single-prong hook, around one end of the "f" sound hole, and a reverse configuration flange, having the appearance of a backwards hook orientation, around the opposing end of the same "f" sound hole, curved surfaces are presented to sound waves moving into the resonance chamber.

In this second variation, sound waves entering into the "f" sound hole move into the resonance chamber through an opening defined by the dual flange configuration, where the opening of the sound hole decreases through the internally extruded curvature of the flanges to a minimum circumference configuration. As the sound waves move further into the resonance chamber, past the minimum circumference point, the sound waves will be exposed to an increasing circumference, defined by the further curvature of the flanges beyond 90 degrees. In this second variation, sound waves are able to take advantage of an expanding fluted curved surface while going into the resonance chamber, as well as exiting the resonance chamber through the sound hole.

Accordingly, it is an object of this invention to provide a means whereby sound waves are able to be subjected to an expanding circumference curvature surface, similar to a horn bell shaped configuration, which provides an increase in tonal quality and volume to a remote listener.

It is a further object of this invention to provide a means whereby a single flange may be incorporated into a resonance chamber to provide the necessary curved surfaces to achieve tonal improvement.

It is a further object of this invention to provide a means whereby multiple flanges may be utilized with a single sound hole to provide tonal improvement.

It is a further object of this invention to provide a means whereby the flange defining the sound hole exhibits significant curvature beyond 90 degrees so as to provide additional barriers and increase the surface area of said barrier surfaces within a resonance chamber.

DESCRIPTION OF THE FIGURES

FIG. 8*a* is a cross-sectional view of the flange, as indicated in FIG. 8 at the location and indicated by viewing line A—A.

FIG. 8*b* is a cross-sectional view of the flange, as indicated in FIG. 8 at the location and indicated by viewing line B—B.

FIG. 8*c* is a cross-sectional view of the flange, as indicated in FIG. 8 at the location and indicated by viewing line C—C.

FIG. 8*d* is a cross-sectional view of the flange, as indicated in FIG. 8 at the location and indicated by viewing line D—D.

FIG. 8*e* is a cross-sectional view of the flange, as indicated in FIG. 8 at the location and indicated by viewing line E—E.

FIG. 8*f* is a cross-sectional view of the flange, as indicated in FIG. 8 at the location and indicated by viewing line F—F.

DETAILED DESCRIPTION OF THE INVENTION

First Variation—Circular Sound Hole Flanges

Figure 1:
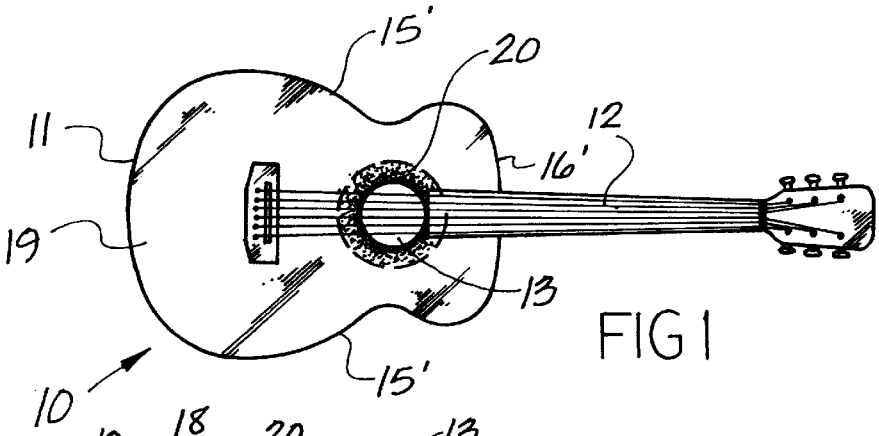
FIG. 1 is a cross-sectional view of a guitar, which has a high flow stringed instrument sound hole, showing a cross-sectional view of the flange.
Figure 2:
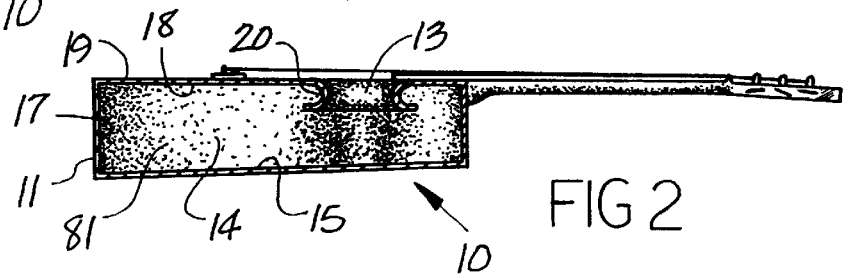
FIG. 2 is a top view of the guitar shown in FIG. 1, in which the flange is indicated around the sound hole.

Referring now to FIG. 1, a typical guitar 10 is shown, having a body 11 that houses a resonance chamber. As is common with most guitars 10, a plurality of strings 12 are stretched taut across a sound hole 13, which is defined as the opening through the top outer surface 19 of guitar body 11, allowing access into their resonance chamber 14, as shown in FIG. 2. Use of a guitar 10 in FIGS. 1 and 2, should only be considered as an example of a string instrument having a round or circular sound hole 13. The scope of this invention should in no way be considered limited to guitars only. It is the intent of this invention to include any string instrument having a sound hole 13.

Referring now also to FIG. 2, a cross sectional view of a typical guitar 10 is shown, where said guitar body 11 is defined by various members that define an enclosed resonance chamber volume 81. Resonance volume 81 is defined by bottom internal wall 15, rear internal wall 17, forward internal wall 16, top internal wall 18, and side internal walls 15'. As it is also shown in FIG. 2, the resonance sound hole 13 is defined by the flange 20.

Figure 3:
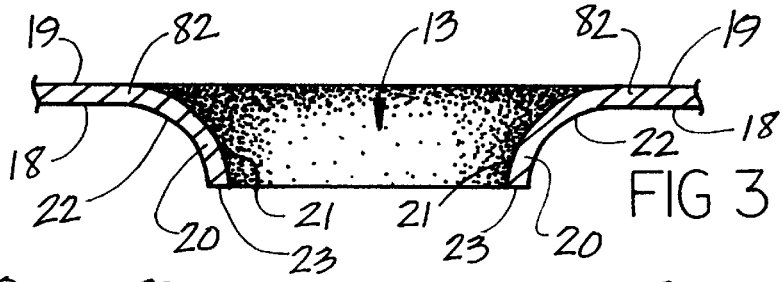
FIG. 3 is a cross-sectional view of a flange having a curvature of approximately 90 degrees.

Referring now also to FIG. 3, a more detailed and close-up view of the resonance sound hole 13 is shown. The resonance sound hole 13 is defined by a recessive curvature of what makes up the top layer 82 of the guitar body 11, defined as the top layer 82 of the guitar body 11. As is shown in FIG. 3, as well as FIG. 2, the top layer 82 begins to curve into the resonance chamber volume 81. The point at where the curvature begins comprises the greatest extent of circumference of what is defined as the resonance sound hole 13. As the top layer 82 begins to curve, the top layer 82 changes into the flange 20. Flange 20 is then defined by the inner flange surface 22, and outer flange surface 21, and terminating end 23. FIG. 3 shows a curvature of approximately 90 degrees orientation for the flange 20, as compared to the top layer 82.

As sound waves move from above the top layer 82 into the funnel portion of the resonance sound hole 13, defined by the flange outer surface 21, the circumference of the available opening will diminish until the curvature of the flange 20 has oriented 90 degrees from the top layer 82. At this point, the sound waves will then move into the resonance chamber volume 81, and reflect off any surfaces defining the resonance chamber volume 81.

Sound waves exiting back through the resonance sound hole 13, where the flanges 20 are oriented as shown in FIG. 3, will move through the resonance sound hole 13, moving from the opening of smaller circumference through the funnel portion that expands into an area of larger circumference. The effect on the sound waves is the same as would be appreciated by any trumpet horn or similar feature. The audio dynamics of this arrangement serve to increase the tone and volume of sound moving out of the guitar 10.

Figure 4:
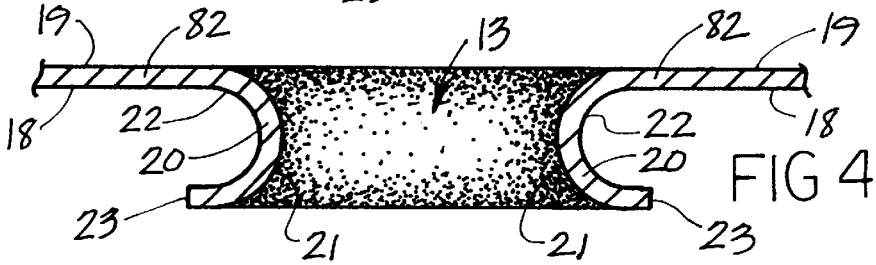
FIG. 4 is a cross-sectional view of a flange having a curvature of approximately 180 degrees.

Referring now to FIG. 4, the flanges 20 are shown in a manner where the curvature has extended from that shown in FIG. 3, to an orientation having an additional 90 degrees. The end 23 of flange 20 is oriented approximately 180 degrees from the top layer 82, so that flange 20 has effectively provided a curved outer surface 21 that presents two opposing funnel-like configurations.

Just as in FIG. 3, sound waves moving into the resonance chamber volume 81 will be subject to an initial constriction of circumference, to the point where the flange 20 is oriented 90 degrees from the top layer 82. Sound waves continuing to move past this point will then be moving through the resonance sound hole 13 where the flange 20 presents a funnel like configuration in which there is an increasing circumference as sound waves move further through the resonance sound hole 13. The configuration shown in FIG. 4 provides the horn like configuration that is advantageous to sound wave volume and tone. Sound waves subjected to movement into the resonance chamber volume 81, past the flange 20 that is oriented 90 degrees to the top layer 82, and where said flange 20 defines an outer surface 21 that continues to follow a curvature, provides an amplification area for sound waves moving into the resonance chamber volume 81. Sound waves exiting the resonance chamber volume 81 through the resonance sound hole 13, as shown in FIG. 4, will be subject to the same improvements as offered in FIG. 3. The obvious improvements in FIG. 4 are that there is an amplification and tone improvement for the sound waves that both enter and exit through the resonance sound hole 13, since the sound waves are subjected to a funnel or bell configuration in either direction.

Figure 5:
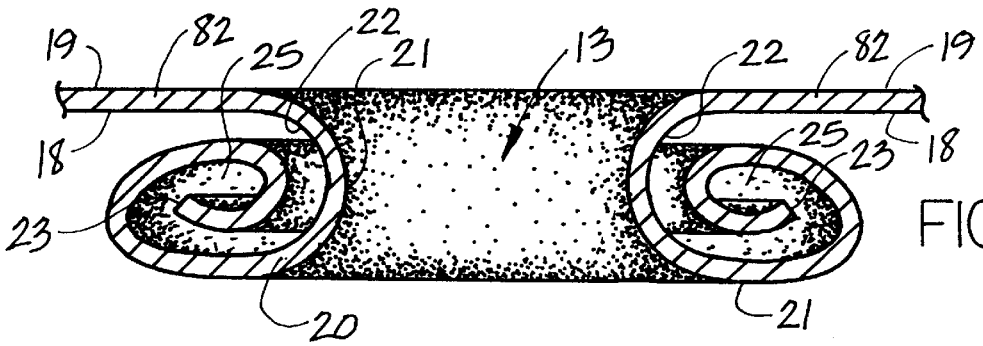
FIG. 5 is a cross-sectional view of a flange that has a curvature in excess of 360 degrees.

Referring now also to feature 5, the flange 20 is shown as having a curvature in excess of 360 degrees, causing a tubular cavity 25 to be defined by the outer side 21 and inner side 22 of flange 20, at the point where the relative curvature exceeds 360 degrees. Said cavity 25 provides extra surface area in which sound waves may be gathered and reflected off of while in the resonance chamber volume 81. Sound waves entering and exiting through sound hole 13 as shown in FIG. 5, will be able to appreciate improvements in tone and volume in the same manner as defined for FIG. 4.

Flange 20 is shown as a continuous extension of the top layer 82 into the resonance chamber volume 81. Flange 20 therefore effectively defines the shape and configuration of the resonance sound hole 13.

Second Variation—Non Uniform Sound Holes

Figure 7:
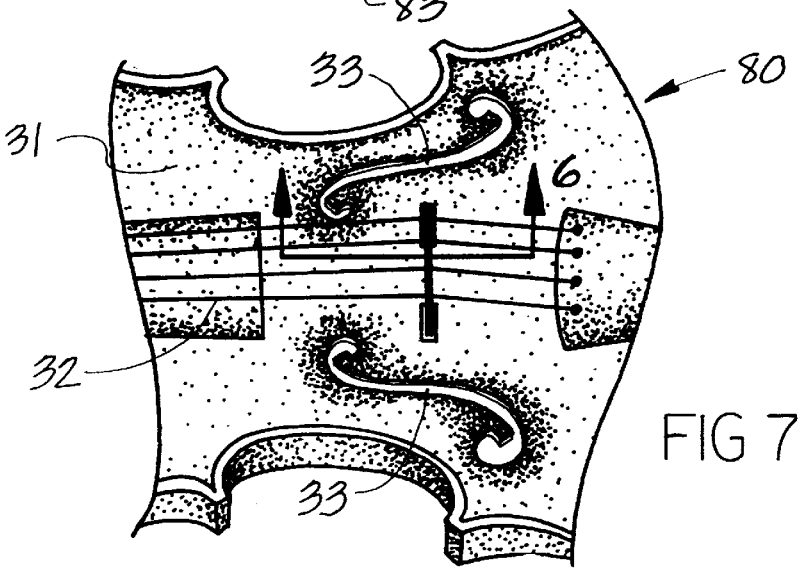
FIG. 7 is a partial top view of a violin body, showing the exterior of the s-hole opening.

String instruments which have non uniform resonance sound holes are exampled by violins. Referring now to FIG. 7, a partial view of a violin 80 is shown, with the body of the violin 80 having strings 32 positioned adjacent to resonance sound holes 33. Sound waves emanating from the vibrating strings 32 are able to enter through the resonance sound holes 33, which in a typical violin 80 allow access to a resonance chamber. The strings 32 themselves, transfer vibrational energy to the resonance chamber 71, causing the resonance chamber 71 to vibrate in conjunction with the strings 32. The vibration of the resonance chamber 71 causes pressure waves to be created within said resonance chamber 71, which are them able to exit through the resonance sound holes 33. The improvement in sound, when utilizing a resonance chamber 71, is readily noticeable with regard to the lower frequencies.

Figure 6:
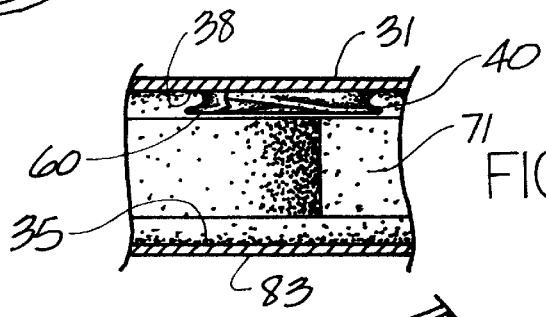
FIG. 6 is a cross-sectional view of a violin body, showing the position of an s-hole flange.

Referring now also to FIG. 6, a partial cross sectional view of a violin 80 is shown, in which the resonance chamber 71 is defined as the space between a top panel 31, having an interior surface 38 and a bottom panel 83 having and interior surface 35. This top panel 31 and bottom panel 83, should be construed as part of the resonance chamber wall. Although references will be made to the top panel 31, it should be understood that the top panel 31 is but one variation of the location for a resonance sound hole 33. The resonance sound hole 33 must be defined as an opening that provides access for sound waves into the resonance chamber 71. The description given below, regarding the sound holes 33 being located in the top panel 31, should be interpreted as being defined through the wall of the resonance chamber 71, and not limited to the top panel 31.

As FIG. 6 shows, flanges 40 and 60 extrude downward from the top panel 81 into the resonance chamber 71.

Use of a violin 80 in FIGS. 6 and 7, should only be considered as an example of a string instrument having a curved resonance sound hole, or a sound hole that has a linear definition, or other non uniform configuration. The scope of this invention should in no way be construed as being limited to violins only. It is the intent of this invention to include any string instrument having a resonance chamber and resonance sound hole.

Figure 8:
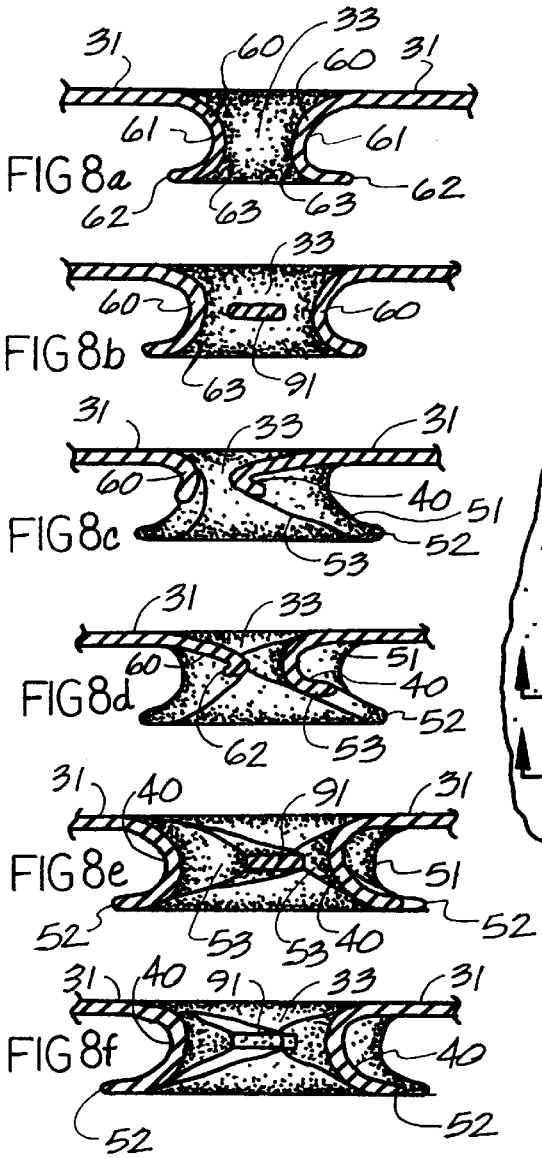
FIG. 8 is an enlarged top view of an s-hole, with the width of a flange indicated through dotted lines, and with views 8*a* through 8*f* so indicated.
Figure 8:
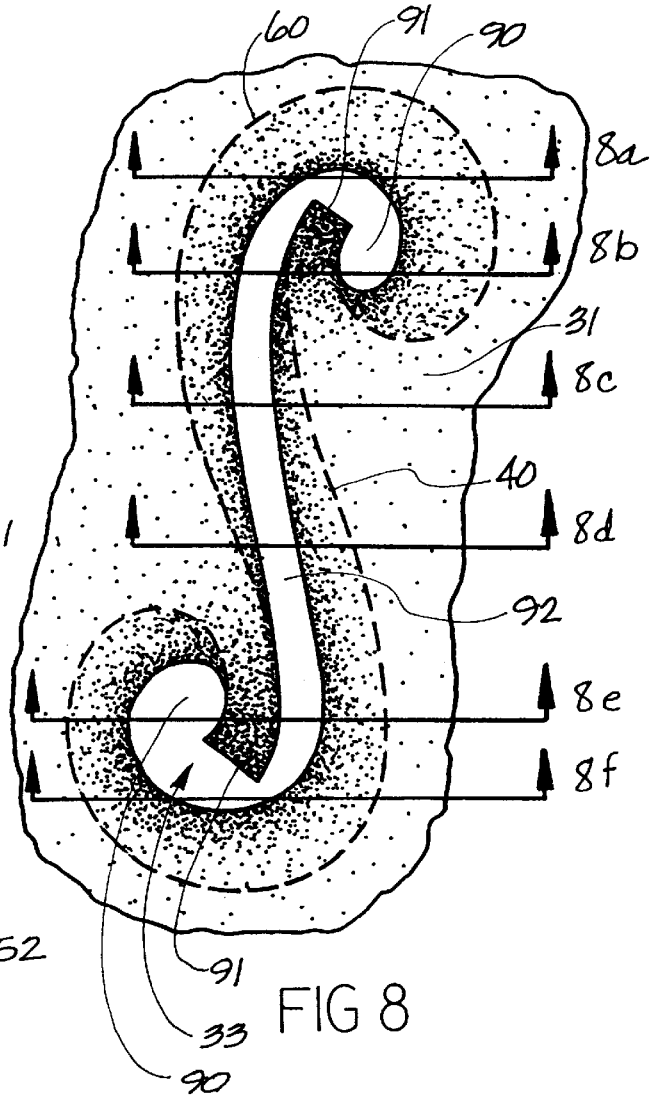

Referring now also to FIG. 8, a more detailed depiction is shown in describing the appearance of a resonance sound hole 33, typically found on string instruments within the family of instruments related to the violin. The resonance sound hole 33 is defined by two enlarged circular openings 90, spaced apart by a contiguous central gap 92. In this type of resonance sound hole 33, the configuration of the opposing circular openings 90 are opposite in their orientation with respect to each other. As it is shown in FIGS. 7 and 8, the entire resonance sound hole 33 is similar to the letter "s" or a scripted letter "f".

While the appropriate flange, as indicated in the first variation, could uniformly surround and define this entire resonance sound hole 33, the structure and configuration of said hole 33 optimally uses two identical but oppositely configured flanges 40 and 60 to properly define the resonance sound hole 33 and flange configuration within the resonance chamber 71.

Figure 9:
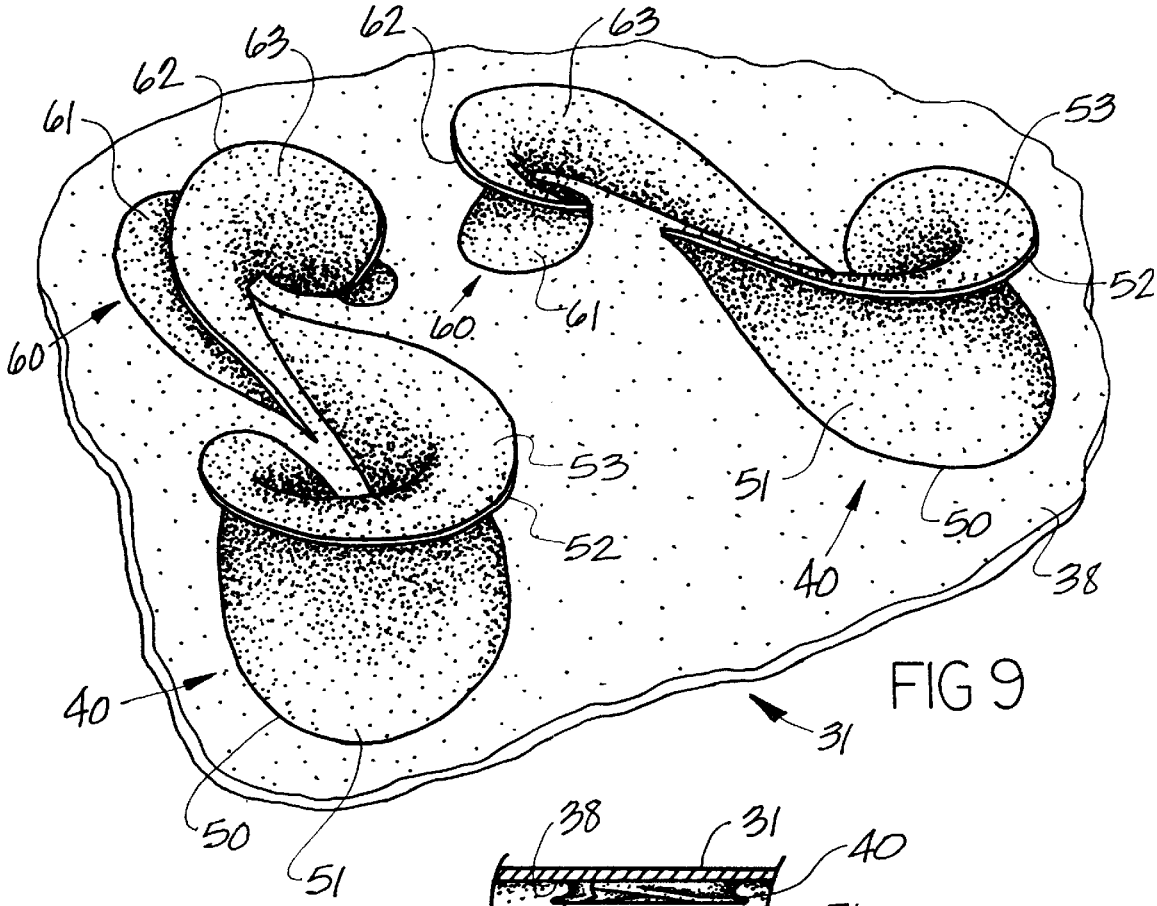
FIG. 9 is a prospective view of an s-hole flange, where the musical instrument is laying upside down, and where the s-hole flange is viewed from below and to the rear of the instrument body cavity.

Referring now also to FIG. 9, the complete set of flanges 40 and 60 are shown, as they would be oriented to each other while defining the respective resonance sound holes 33. As FIG. 9 shows, flanges 40 and 60 protrude into the resonance chamber 71 exhibiting continuous curved surfaces, where said flanges 40 and 60 define the actual holes 33 themselves.

These flanges 40 and 60 provide some of the same benefits as was seen in FIG. 4, discussed above. Sound waves entering through said sound holes 33 into resonance chamber 71 acquire the benefits of tonal sound improvement, due to the fact that said sound waves travel in both directions through an area in which the circumference of said area increases with distance, similar to a musical horn instrument end or funnel.

FIG. 9 offers a view of virtually every exposed side edge of flanges 40 and 60. For description purposes, flange 40 and 60 should be considered identical, except for the fact that they are oriented opposite of each other as to position, and not simply as mirror images.

Referring again to FIG. 8, the typical structural design of the resonance hole 33 is seen, when viewed in conjunction with FIGS. 8A through 8F. FIG. 8 indicates the typical top view of resonance sound hole 33. This hole 33 comprises the opening into the resonance chamber, where said opening is defined through the portion of the violin 30 indicated as the top panel 31. It should be understood that sound hole 33 is not simply a cut-out or punch-out through a relatively flat panel 31. Sound hole 33 is defined both by the top panel 31, and by the flanges 40 and 60. This is more clearly seen, through the comparison of the progressive cross sectional views in FIGS. 8A through 8F.

FIG. 8 exemplifies the location along the length of the resonance sound hole 33 that is defined in part by the inwardly curving flanges 40 and 60. Those points along a length of said hole 33, that are adjacent to any space between the defined hole 33 and dashed lines for flanges 40 and 60, comprise inwardly sloping sides. For example, FIG. 8A, which indicates view AA in FIG. 8, clearly shows that the top panel 31 begins to curve inward, where the curved sides are defined as flange 60. The transition from a top panel 31 to flange 60 should be understood to be that point where an arcual edge is defined as the top panel 31 begins to curve or recede inward into the resonance chamber 71. The flange portion 60, as well as flange 40, may be understood as any curved extension of a surface into the resonance chamber area that has receded below the normal plane of top panel 31.

FIG. 8A indicates a cross sectional view similar to that shown in FIG. 4 regarding the first variation. Sound waves traveling through the passageway defined by flanges 60, will derive the same benefits in FIG. 8A, as for that described regarding FIG. 4. In both cases, sound waves will be subjected to movement through a passageway that has includes movement through a smaller circumference to a larger circumference.

As FIG. 8A new indicates, flanges 60 are defined by an external side 63 that presents an arcual surface that defines the actual resonance sound hole 33. As the external side 63 continues to follow an arcual line of curvature, it will terminate at flange end 62 approximately 180 degrees of curvature, in relation to the orientation of the top panel 31. Internal side 61 presents a curved surface within the resonance chamber 71, that increases the surface area to define a barrier that sound waves may reflect off of.

Referring now to FIG. 8B, the cross sectional view of position BB in FIG. 8 is shown. Although flanges 60 have a configuration similar to that shown in FIG. 8A, extension 91 has no flange defining its location, or associated directly with the edge of said extension 91. FIG. 8 also shows and indicates the extension 91, which when viewed concurrently with FIG. 8B, shows that the top panel 31 has angled slightly inward toward the resonance chamber 71. This angled orientation is not dependent upon the inwardly curved set of flanges. The peripheral end of extension 91 is positioned inbetween opposing outer surfaces 63 at approximately their closest point of contact between them, which has the effect of allowing sound waves passing between the extension 91 and adjacent outer surface 63 to benefit from the horn like configuration both above the extension 91 and below the extension 91. In addition, the movement of air past a normal extension 91 is somewhat interrupted, where the extension 91 is not recessed from the wall of the resonance chamber, or the top panel 31 of the violin 80. The angled orientation of the extension 91, coupled with the curved surfaces of the flanges 40 and 60 reduce the air drag through the resonance sound hole 33.

To more fully understand FIGS. 8C through 8F, they should be considered concurrently with FIG. 8, and also with FIG. 9. FIG. 9 shows an inverted view of the flanges 40 and 60, with them showing protruding upward from the interior side of top panel 31. Referring now to FIG. 9, a perspective view of the dual set of flanges 40 and 60, that are oriented about each of the resonance sound holes 33 is shown. Top panel 31 begins its curvature inward toward the resonance chamber 71, as indicated by curved line 50, which is the first point of curvature seen as the top panel 31 transforms into flange 40 by a way of the curvature inward toward the resonance chamber.

The continued arcual curvature is defined by interior side 51, which terminates at a peripheral edge 52. External side 53 defines the surfaces by which sound waves will encounter when moving through the resonance sound hole 33, and likewise terminates at the peripheral edge 52.

Flange 60 presents and oppositely oriented flange, which curves inward with its internal side 61 terminating and peripheral end 62, and with the external curved side 63 defines the surfaces which sound waves will encounter when moving through the resonance sound hole 33, and likewise terminates at the peripheral edge 62.

The rate of curvature, in relation to distance from the top panel 31 to the peripheral end 52 or 62, is determinant on the position of the flange 40 or 60 along the length of the sound hole 33. As FIG. 8 indicates, flange 40 and 60 do not extend along the entire side of the sound hole 33, but gradually taper in height has the flange defines sound hole 33 closer to the extension 91, maintaining the curvature of approximately 180 degrees in relation to the top panel 31. This is readily seen and FIG. 9, which shows the flanges 40 and 60 having a maximum depth around the circular openings 90, and reducing in depth along the length of the channel 92, reducing in depth until flange 40 or 60 merges into the extension 91. This is indicated and shown in FIG. 8C, which shows flange 60 on the left side, beginning to taper as to depth, while the opposing flange 40 is increasing in depth. FIG. 8D shows that flange 60 has tapered further, to the point that it has very little depth at all, while flange 40 has increased in depth and size. FIG. 8E shows flange 60 is no longer involved in this figure, but that flange 40 has increased to a maximum depth as it is adjacent to the circular opening 90. FIG. 8F shows that flange 40 remains at a fairly constant maximum depth as it encircles and defines the resonance sound hole 33 which encircles the extension 91.

It should be understood that flanges 20, 40 and 60 may be constructed out of any material that it is conducive to reflection of sound waves. The flanges may be incorporated into the instrument during its construction, or may be attached following the construction of instrument.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. An improved musical stringed instrument, having a resonance sound hole, and a resonance chamber, where said resonance sound hole comprises an opening which allows access into the resonance chamber, which is defined by inwardly projecting flange, that is parallel to the resonance chamber wall, and define an arcual surface that recedes into the resonance chamber, and where said flange projects into the resonance chamber to define a resonance sound hole having a side that decreases in circumference in relation to the depth into the resonance chamber.

2. An improved musical stringed instrument, as recited in claim 1, in which the flanges define a curvature of 90 degrees in relation to the resonance chamber wall, and which define a resonance sound hole having a minimum circumference at its terminating end.

3. An improved musical stringed instrument, as recited in claim 1, in which the flange defines a curvature in excess of 90 degrees up to 180 degrees, in relation to the resonance chamber wall of the musical instrument, and which defines a resonance sound hole having a minimum circumference, with the flange further defining a continued resonance sound hole passageway that increases from the minimum circumference to a greater circumference in relation to the depth of the flange.

4. An improved musical stringed instrument, as recited in claim 2, in which the flange defines a curvature in excess of 180 degrees, in relation to the resonance chamber wall of the musical instrument, and where the flange has an internal side that further defines a tubular cavity within the resonance chamber.

5. An improved musical stringed instrument, having a resonance chamber, having a circular uniform resonance sound hole, with a single circular shaped flange defining the resonance sound hole, where said resonance sound hole comprises an opening through the chamber wall of the musical instrument, which is defined by a single inwardly projecting flange, where said flange comprises:

(a) an extension into the resonance chamber, having an internal and external side, with a terminating end, and where the internal and external sides are initially parallel to the top portion of the instrument, and where said exterior side defines an arcual surface that recedes into the resonance chamber, and where said exterior surface defines the opening of the sound hole, that decreases in circumference as the flange projects into the resonance chamber.

6. An improved musical stringed instrument, having a resonance chamber, with a circular uniform resonance sound hole, with a single circular shaped flange defining the resonance sound hole, as recited in claim 5, where said flange defines an external side having an arc of 90 degrees, in relation to in relation to the resonance chamber wall of the musical instrument.

7. An improved musical stringed instrument, having a resonance chamber, with a circular uniform resonance sound hole, with a single circular shaped flange defining the resonance sound hole, as recited in claim 5, where said flange defines an external side having an arc of greater than 90 degrees, up to 180 degrees, in relation to the resonance chamber wall of the musical instrument, so as to define a passageway that allows sound waves moving in either direction to be subjected to the exterior side of the flange that defines a passageway that increases in circumference as the sound waves move through said passageway.

8. An improved musical stringed instrument, having a resonance chamber, with a circular uniform resonance sound hole, with a single circular shaped flange defining the resonance sound hole, as recited in claim 5, where said flange defines an external side having an arc of greater than 180 degrees, in relation to the resonance chamber wall of the musical instrument, so that the internal sides of the flange define a tubular cavity that increases the surface area of the resonance chamber.

9. An improved musical stringed instrument, having a resonance chamber, having an f-hole, with said f-hole defined through the top panel of the instrument by two flanges that each encircle a panel extension where said flanges comprise an extension into the resonance chamber, having an internal and external side, with a terminating lip, and where the internal and external sides are initially parallel to the resonance chamber wall of the musical instrument, and where said exterior side defines an arcual surface that recedes into the resonance chamber, and where said exterior surface defines the opening of the sound hole, that decreases in circumference as the flange projects into the resonance chamber, and where said flanges have a varying depth in relation to their position along the length of the resonance hole.

10. An improved musical stringed instrument, having a resonance chamber, and having an f-hole, as recited in claim 9, where said flanges comprise an external and internal side, with a terminating lip, where said flanges have an arcual degree of more than 90 degrees, but less than 360 degrees, in relation to the resonance chamber wall, where said flanges provide an external side which allows sound waves to move through a passageway, defined by said external side, from a passageway having a minimum circumference to a larger circumference in either direction.

11. An improved musical stringed instrument, having a resonance chamber, and having an f-hole, as recited in claim 9, where said flanges decrease in depth as they approach the extension, defined by the wall of the resonance chamber, and where said extension comprises an angled portion of the wall that positions the extension within the minimum circumference defined by the outer surface of the respective flange.

* * * * *